US008994601B2

(12) United States Patent
Hefele et al.

(10) Patent No.: US 8,994,601 B2
(45) Date of Patent: Mar. 31, 2015

(54) BROADBAND OMNIDIRECTIONAL ANTENNA

(75) Inventors: Tanja Hefele, Waakirchen (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 324 days.

(21) Appl. No.: 13/635,733

(22) PCT Filed: Mar. 9, 2011

(86) PCT No.: PCT/EP2011/001163
§ 371 (c)(1),
(2), (4) Date: Sep. 18, 2012

(87) PCT Pub. No.: WO2011/113542
PCT Pub. Date: Sep. 22, 2011

(65) Prior Publication Data

US 2013/0009834 A1 Jan. 10, 2013

(30) Foreign Application Priority Data

Mar. 18, 2010 (DE) ..... 10 2010 011 867

(51) Int. Cl.
*H01Q 13/10* (2006.01)
*H01Q 9/32* (2006.01)
(Continued)

(52) U.S. Cl.
CPC ..... *H01Q 9/32* (2013.01); *H01Q 13/12* (2013.01); *H01Q 13/16* (2013.01)
USPC ..... 343/770; 343/767

(58) Field of Classification Search
USPC ..... 343/767, 770, 846, 848
See application file for complete search history.

(56) References Cited

U.S. PATENT DOCUMENTS 2,660,674 A * 11/1953 Brown ..... 343/770
4,763,130 A 8/1988 Weinstein
5,220,337 A 6/1993 Ajioka
(Continued)

FOREIGN PATENT DOCUMENTS

CN 2718805 Y 8/2005
DE 20 2004 008770 8/2004
(Continued)

OTHER PUBLICATIONS

Y. Vu et al., "UWB Vivaldi Antenna for Impulse radio Beamforming", Department of Informatics, University of Oslo, Norway, retrieved Sep. 17, 2012, 6 pages.

*Primary Examiner* — Tan Ho
(74) *Attorney, Agent, or Firm* — Nixon & Vanderhye P.C.

(57) ABSTRACT

An improved broadband omnidirectional antenna is distinguished by the following features: the omnidirectional antenna is in the form of a dual-polarized antenna, the dual-polarized antenna comprises a horizontally polarized radiating element (3) in addition to the vertically polarized radiating element (1; 1*a*, 1*b*) which is in the form of a monopole, the horizontally polarized radiating element (3) comprises slots (43, 43') which are provided offset in the circumferential direction in the casing (11*a*) of the vertically polarized radiating element (1; 1*a*, 1*b*) which is in the form of a monopole, a feed device (111) for the horizontally polarized radiating element (3) being provided in the interior (11*d*) of the vertically polarized radiating element (1; 1*a*, 1*b*) which is in the form of a monopole, and the feed device (111) comprises separate feed devices (111*a*) for a plurality of slots (43, 43'), the respectively associated slots (43, 43') being separately excited by means of said feed devices.

27 Claims, 5 Drawing Sheets

(51) Int. Cl.
*H01Q 13/12* (2006.01)
*H01Q 13/16* (2006.01)

(56) References Cited

U.S. PATENT DOCUMENTS

| | | | | |
|---|---|---|---|---|
| 5,754,143 | A | 5/1998 | Warnagiris et al. | |
| 5,870,061 | A * | 2/1999 | Casciola et al. | 343/771 |
| 5,929,821 | A * | 7/1999 | Goldstein et al. | 343/770 |
| 6,703,984 | B2 * | 3/2004 | Schadler | 343/770 |
| 2002/0171595 | A1 | 11/2002 | Schultze et al. | |
| 2003/0184485 | A1 | 10/2003 | Jiang et al. | |

FOREIGN PATENT DOCUMENTS

| | | |
|---|---|---|
| DE | 10 2008 003 532 | 3/2009 |
| EP | 0 195 356 | 9/1986 |
| EP | 0 515 192 A1 | 11/1992 |
| EP | 1 695 416 | 6/2008 |
| EP | 2 034 557 A2 | 3/2009 |

* cited by examiner

BROADBAND OMNIDIRECTIONAL ANTENNA

This application is the U.S. national phase of International Application No. PCT/EP2011/001163 filed 9 Mar. 2011 which designated the U.S. and claims priority to DE 10 2010 011 867.2 filed 18 Mar. 2010, the entire contents of each of which are hereby incorporated by reference.

FIELD

The invention relates to a broadband omnidirectional antenna in accordance with the preamble of claim 1.

Omnidirectional antennae are used for example as indoor antennae. They are multiband capable and preferably radiate with a vertical polarisation orientation. For this purpose, they may comprise a ground or earth plate, which may for example be formed in a disc shape, on which a monopole radiator rises transverse and in particular perpendicular to the earth plate. The entire arrangement is generally covered by a protective housing, that is to say an antenna cover (radome).

A generic omnidirectional and thus vertically polarised antenna is known for example from EP 1 695 416 B1. The monopole radiator known therefrom rises perpendicularly above an earth plate or counterweight surface, from which it is galvanically separated. In this context, the vertically polarised monopole radiator comprises at least approximately a conical or frustum-shaped radiator portion (the divergent extension of which points away from the earth plate or counterweight surface) and/or a cylindrical or cup-shaped radiator portion. Preferably, the conical or frustum-shaped radiator portion, of which the divergent extension points away from the counterweight surface, is initially attached to the counterweight surface and subsequently transitions into a tubular radiator portion. It is preferably supplied via a series cable coupling which is formed in the central axis or axis of symmetry of the monopole radiator.

An antenna of this type is particularly expedient as an indoor antenna. It is distinguished by having a wide bandwidth while also operating in various frequency ranges and having a very short overall construction.

BACKGROUND AND SUMMARY

As well as omnidirectional antennae of the type described above, in principle completely different types of antenna are also known. Thus, U.S. Pat. No. 5,220,337 A for example discloses a directional radiator which is for example in the form of a cavity radiator having a plurality of slots, which are positioned offset in the circumferential direction on the circumferential side walls thereof, the slots being supplied separately via separate coaxial cables.

DE 10 2008 003 532 A1 discloses an antenna for satellite reception. This antenna comprises a broadband omnidirectional antenna having a monopole radiator, which is vertically polarised and rises above an earth plate or counterweight surface. In this context, the omnidirectional antenna is in the form of a dual-polarised antenna, the dual-polarised antenna comprising a horizontally polarised radiator in addition to the vertically polarised monopole radiator.

A broadband Vivaldi or Vivaldi-like antenna means is known in principle from the publication "Vu T. A. et al.: UWB Vivaldi Antenna for Impulse Radio Beamforming. In: NORCHIP 2009 conference report, pp. 1-5". In this context, the shown and described Vivaldi antennae are formed with a microstrip structure.

Finally, U.S. Pat. No. 4,763,130 discloses an antenna arrangement comprising a cylindrical casing in which slots, which are positioned mutually offset in the circumferential direction and extend mutually parallel and parallel to the axial central axis, are formed in the radiator casing and are supplied by a supply means which extends in the interior of the radiator casing.

The object of the present invention is to provide an omnidirectional antenna which is in principle broadband, which offers a wider range of applications than the prior art and should also not take up much space.

The object is achieved according to the invention in accordance with the features specified in claim 1. Advantageous embodiments of the invention are specified in the dependent claims.

It may be considered very surprising that the antenna according to the invention provides further advantages—by comparison with conventional solutions—without the antenna as a whole taking up more space, for example.

By contrast with a generic single-polarised omnidirectional antenna, the antenna according to the invention instead consists of a dual-polarised omnidirectional radiator, and for this comprises a vertically polarised monopole radiator and an additional horizontally polarised radiator means.

The solution according to the invention can be achieved in that slots are formed in a conical or cylindrical radiator or radiator portion of a vertically polarised monopole radiator, and are positioned offset in the circumferential direction and extend in the axial longitudinal direction of the radiator. These make it possible to provide a corresponding supply means, via which the slots can be supplied so as to generate a horizontally polarised radiation pattern, within the generally rotationally symmetrical monopole radiator.

According to the invention, this can be provided by using corresponding coupling pins or coupling cables, which are preferably arranged internally in the hollow, rotationally symmetrical or at least approximately rotationally symmetrical monopole radiator in such a way that, coming from a supply point in the same circumferential direction, they cross the slots in the casing of the at least approximately rotationally symmetrical monopole radiator. The supply is preferably provided by a central star-shaped distribution point in the interior of the monopole radiator which is surrounded by a casing.

In this context, the supply structure can be formed in various ways. For example, a central supply point may be provided (on a circuit board), from which the supply lines for the slot radiators proceed. Equally, a tubular or frustum-shaped support (depending on the shape of the monopole radiator) could also be inserted into the interior of this radiator, on which the corresponding supply lines are formed using a galvanic contact with the electrically conductive casing of the monopole radiator. Various concepts can be implemented in this context. However, the supply can also be provided via coaxial cables or any other lines which consist of at least two conductors (two-wire line, microstrip, slot line etc.), the external conductor of each coaxial cable (one conductor) on one side of the slot and the internal conductor (the other conductor), which crosses the slot, on the other side of the slot being electrically galvanically (or capacitively) coupled.

The supply structure for the horizontally polarised radiator may also for example be provided via a microstrip line structure. In other words, a disc-shaped substrate (dielectric) is preferably arranged in the interior of the conical, frustum-shaped and/or cylindrical monopole radiator, specifically parallel to the counterweight surface, radial supply lines proceeding outwards from a central star-shaped distribution point and each subsequently proceeding in an arc shape in the same circumferential direction at a predetermined distance, which is as small as possible, from the casing of the cylindrical or frustum-shaped monopole radiator, to an endpoint, these arc-shaped line portions crossing and thus exciting the slots.

In a particularly preferred embodiment, however, a multiple Vivaldi antenna arrangement is provided as a horizontal radiator means as a supply structure for the slots in the casing of the monopole radiator.

As is known, a Vivaldi antenna is a special case of a longitudinal antenna, more specifically a special case of a tapered slot antenna (TSA), the edges or rims of the slots preferably widening in a funnel shape, with a defined exponential formula, from a closed end to the open end thereof. This slot which widens in a funnel shape thus acts as a radiator element, it being possible for the slot to be supplied and excited via a supply microstrip line which crosses the slot.

With corresponding selection of the geometric dimensions and appropriate dimensioning of the supply, Vivaldi antennae can me made very broadband.

In the context of the invention, Vivaldi antennae or other, in particular linearly tapered slot antennae have the advantage that they are easy to produce in terms of construction, they can be arranged inside the rotationally symmetrical hollow body of the monopole radiator (and thus do not contribute to an increase in the construction height), and above all the preferably exponential funnel shapes, that is to say the various radiation directions of the Vivaldi antennae, can be orientated directly with the slots in the rotationally symmetrical or approximately rotationally symmetrical construction of the casing of the monopole radiator. This construction and the construction between the Vivaldi antenna and the slot-shaped configuration in particular of the cylindrical casing of the monopole radiator result in a particularly broadband antenna without tolerance problems.

Various numbers of the aforementioned slots in the casing of the at least approximately rotationally symmetrical monopole radiator can be selected. The higher the number of slots, the more rotationally symmetrical the horizontal radiation pattern. Preferably, at least three or four slots extending in the circumferential direction of the casing of the monopole radiator are provided.

The length and width of the slots can be optimised in accordance with the frequency ranges used. The slots preferably end open in the vertical radiation direction of the monopole radiator, but may also be formed closed, in particular if they are dimensioned correspondingly longer. The slot structure can also be formed so as to repeat in the circumferential direction in such a way that it is formed in a U shape, that is to say consists of a double slot, it being possible in this case for the electrically conductive surface remaining between the slots to be held by a dielectric support construction, these constructions being inserted into the slots for filling for example. It would equally be possible to form the entire monopole radiator or large parts thereof on a dielectric body, on which the correspondingly electrically conductive casing is formed as a layer, again making it possible to form corresponding U-shaped double slots without difficulty by omitting electrically conductive layer portions.

The vertically polarised radiator means can be supplied via the central axis, that is to say the axis of symmetry, of the monopole radiator, for example by means of a series (capacitive) coupling for the monopole vertically polarised radiator, as is disclosed in DE 103 59 605 B4. In this case, the horizontally polarised radiator is preferably supplied by means of a coaxial cable, which first extends through a through-opening in the earth or counterweight surface and of which a particular cable length is arranged extending on the counterweight surface, until the coaxial cable is passed through a further through-opening in the casing of the monopole radiator, at which it is connected for example electrically conductively to this casing, into the interior thereof, specifically as far as an aforementioned star-shaped distribution point of a corresponding supply structure for exciting the slots.

The coaxial supply lines, which extend outside the generally rotationally symmetrical monopole radiator, for the horizontally polarised radiator means are preferably of a length which is selected in such a way that it is not a multiple of $\lambda/2$ for an operating wavelength which is used by the vertically polarised radiator.

However, in the context of the invention, the supply for the vertically and the horizontally polarised radiator may also be provided the other way round, in such a way that for example the supply for the horizontally polarised radiator is provided in the vertical central axis or axis of symmetry and the supply for the vertically polarised monopole radiator is provided outside this central axis or axis of symmetry.

BRIEF DESCRIPTION OF THE DRAWINGS

In the following, the invention is explained in greater detail by way of drawings, in which, in detail.

DETAILED DESCRIPTION OF PREFERRED EMBODIMENTS

Figure 1:
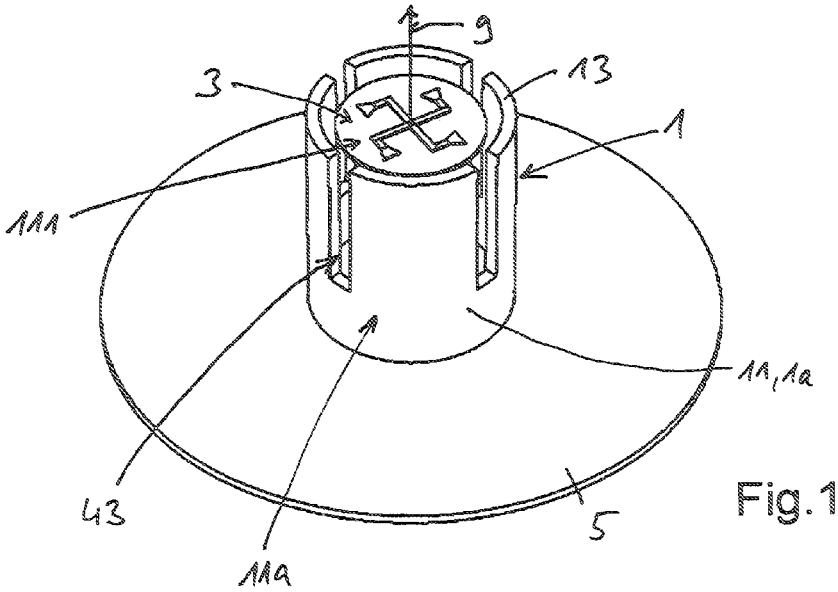
FIG. 1 is a three-dimensional drawing of a first embodiment according to the invention of an omnidirectional antenna.

A first embodiment of the invention will initially be explained in greater detail by way of FIGS. 1 to 4.

In this variant, the dual-polarised omnidirectional antenna comprises a substantially vertically polarised antenna means 1 (that is to say a substantially vertically polarised radiator 1) and a substantially horizontally polarised antenna means 3 (that is to say a substantially horizontally polarised radiator means 3).

In this context, the entire antenna arrangement is constructed on a ground, base or earth plate 5 or surface 5, also referred to in the following in part as a counterweight surface 5 or reflector 5. In the embodiment shown, this counterweight surface 5 is circular or disc-shaped. However, completely different shapes are also possible. Thus, the counterweight surface 5 may also for example be square, rectangular, oval etc., and thus generally also n-polygonal etc. Other embodiments of the counterweight surface are also conceivable, for example as a grille.

The vertically polarised antenna means 1 substantially consists of the aforementioned monopole radiator means 1, which is a hollow cylinder in the embodiment shown. In other words, the vertically polarised monopole radiator 1 is formed at least approximately as a body of revolution 11, that is to say in particular as an internally hollow body of revolution 11 comprising a rotation or radiation casing 11*a* which is rotationally symmetrical about a central axis or axis of symmetry 9. For this purpose, the body of revolution 11 is of a predetermined height H, as measured from the counterweight surface 5 to the upper rim 13 of the cylindrical monopole radiator 1.

Figure 2:
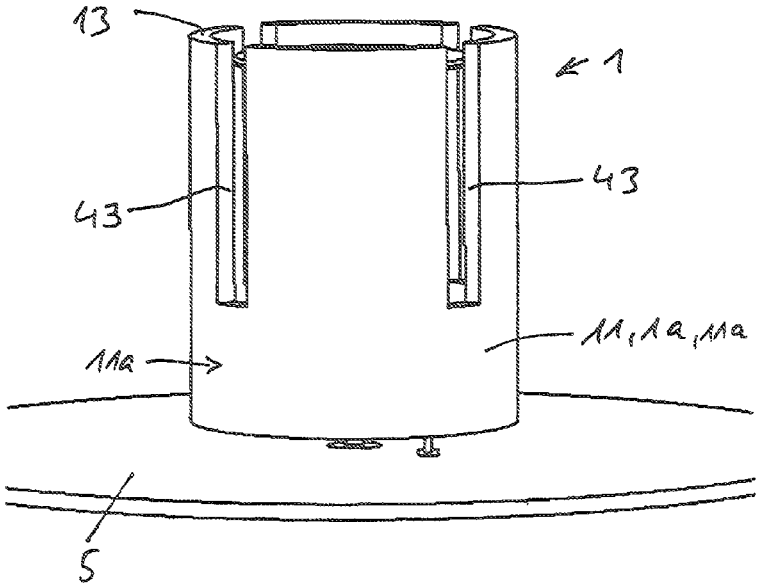
FIG. 2 is a more shallow three-dimensional horizontal view, by contrast with FIG. 1 only showing the monopole radiator having longitudinal or vertical slots formed in the radiator casing.
Figure 3:
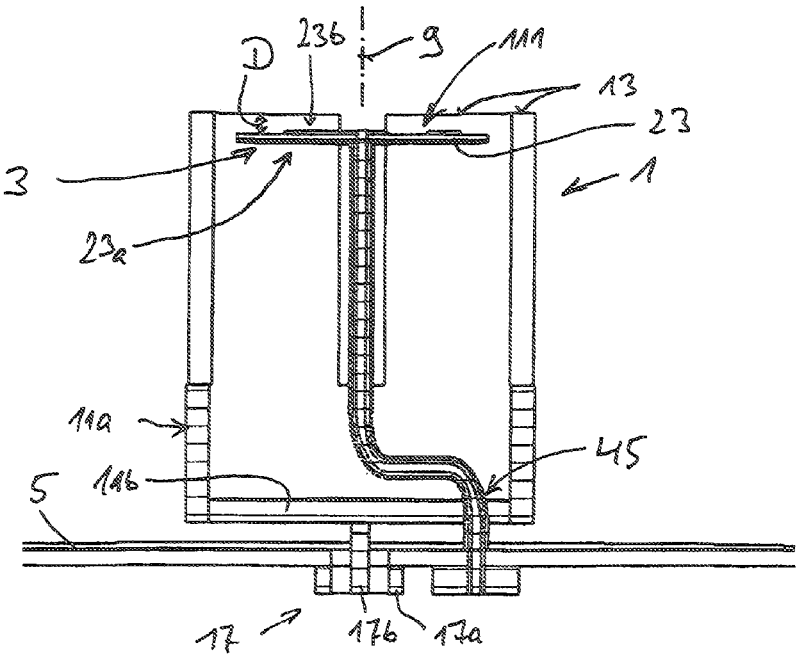
FIG. 3 is a schematic axial cross-sectional drawing perpendicular to the counterweight surface showing the embodiment according to either FIG. 1 or FIG. 2.

The monopole radiator 1, in the embodiment shown in the form of a cylindrical radiator means 1*a*, is galvanically separated from the earth or counterweight surface 5, as can be seen in particular from the highly oblique perspective view according to FIG. 2 and in the axial vertical sectional view of FIG. 3, inter alia.

It can also be seen that the cylindrical radiator means 1*a* comprises the cup-shaped base 11*b*, which extends adjacent to the earth or counterweight surface 5, as well as the radiator casing 11*a*, which in this case is cylindrical.

The vertically polarised monopole or monopole-like radiator means 1 which is formed in this manner can be constructed and supplied in the manner which is basically known from DE 103 59 605 B4, the entire disclosure of which is incorporated herein by reference.

Figure 4:
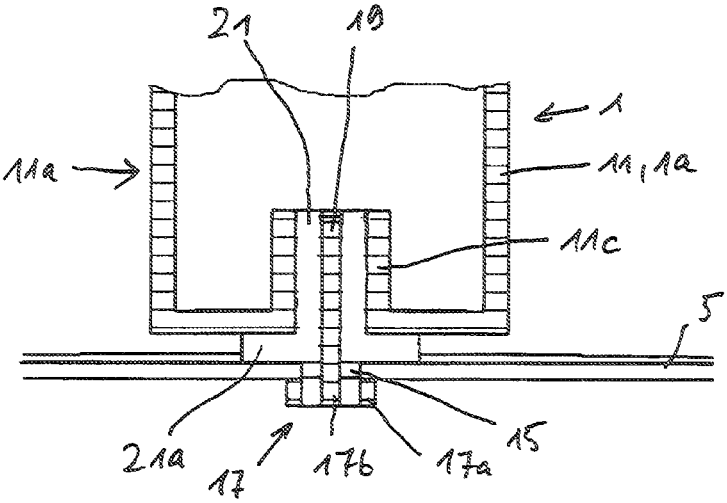
FIG. 4 is a schematic detail of a series (capacitive) supply of the monopole radiator.

From the aforementioned publication, it can be seen that, as shown for example in FIG. 4, a recess 15 is made in the centre of the base plate 5, and that a coaxial plug connection 17 is fixed thereto, the external conductor 17*a* of which is galvanically connected for example to the earth or counterweight surface 5, and the internal conductor 17*b* of which is separated from the external conductor 17*a* by appropriate measures (insulator plate). The internal conductor 17*b* is guided inside the external conductor 17*a* through the recess 15 and electrogalvanically connected to an internal conductor coupling element 19 which extends above the base plate 5 by a particular height. This coupling element 19 preferably extends perpendicular to the plane of the counterweight surface 5. An insulation sleeve 21 is placed thereon, having a lower widened contact flange 21*a* on which the cylindrical radiator casing 11*a* of the vertically polarised radiator means 1, 1*a*, which is formed with a cylindrical coupling portion 11*c*, is subsequently placed, the cylindrical radiator casing 11*a* being electrically, that is to say galvanically, connected to the cylindrical coupling portion 11*c* via the base 11*b*.

Otherwise, as shown in cross-section in a simplified manner in FIG. 3, the electrically conductive radiator casing 11*a* of the radiator 1 can be supplied via an internal conductor 17*b*, which passes through an external conductor 17*a*, which is connected to the counterweight surface 5, so as to be galvanically separated therefrom, resulting in a coaxial plug connector 17 being formed in the region of the recess of the counterweight surface 5 (as can be seen in FIG. 3). Conventionally, for this purpose an insulator is also further provided between the internal and external conductor and between the counterweight surface 5 and the base 11*b*, and keeps the radiator 1 separated from the counterweight surface 5 and the internal conductor 17*b* separated from the external conductor 17*a*.

From the further drawings, it can be seen that in the embodiment shown a substrate or dielectric 23 is arranged at a small distance D below the upper rim 13 of the radiator means 1, la and acts as a base portion of a plurality of Vivaldi antenna means 25. This plurality of Vivaldi antenna means 25 forms a supply structure 111 for supplying the slots, which will be discussed further in the following, in the radiator casing 11*a* of the monopole radiator 1, 1*a*.

Vivaldi antenna means are basically tapered slot antennae (TSAs)—that is to say widened slot antennae. They are thus broadband antennae which are also used as the sole radiation elements for example in the millimeter wavelength range. They are often formed on a double-sided metal-coated substrate 23.

In the embodiment shown, the dielectric 23 is disc-shaped and has a diameter which is equal to or slightly less than the internal diameter of the cylindrical electrically conductive casing 11*a*.

Figure 5:
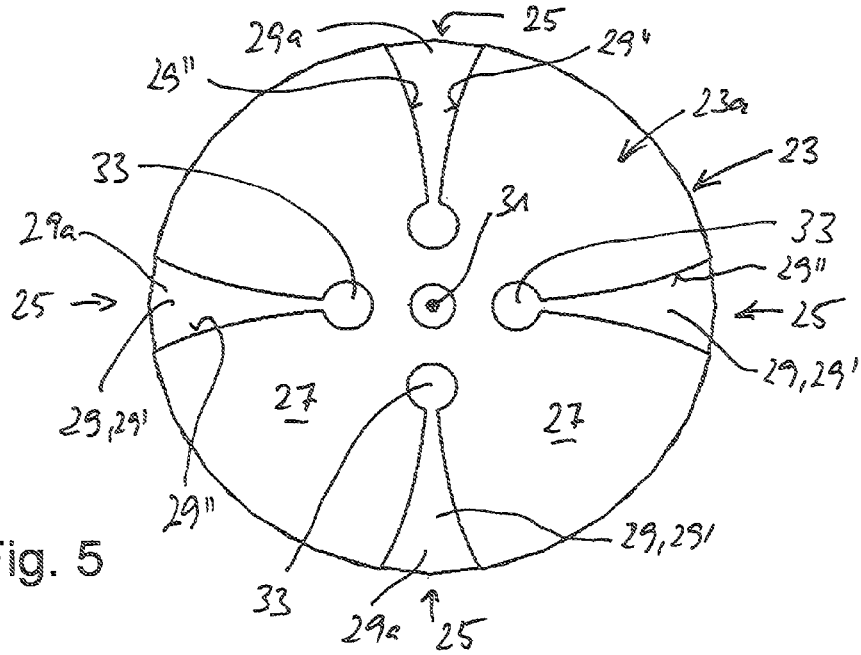
FIG. 5 is a schematic plan view of a first supply structure according to the invention using a plurality of Vivaldi antennae.

In accordance with FIG. 5, four Vivaldi antennae 25 are provided on this disc-shaped substrate 23, at equal distances in the circumferential direction, and are thus formed, in other words, so as to be positioned offset at 90° intervals in the circumferential direction.

The Vivaldi or Vivaldi-like antenna means 25, that is to say in general the tapered slot antennae 25, consist of a support material or substrate 23 (dielectric 23), in which, for example on the underside 23*a* facing towards the counterweight surface 5, a conductive layer 27 is formed which comprises radial slot-shaped or groove-shaped recesses 29, which are positioned mutually offset by 90° in the circumferential direction (see FIG. 5). Each of the slot-shaped recesses 29 starts with a circular recess 33, generally adjacent to the vicinity of the centre 31 of the substrate 23, the slot-shaped structure 29, which widens in a funnel shape towards the outside and in the region of which the substrate 23 is free of a conductive layer, proceeding from each of the four circular recesses 33, which are likewise positioned offset by 90° in the circumferential direction. As a result of this circular free space 33, the slot line 29' which is formed by the slot-shaped recess 29 is made to be broadband, this circular free space 33 preferably being a quarter-wavelength long. In the embodiment shown, the recesses 29 which extend towards the outside in a funnel shape extend in the radial direction, that is to say they are in this case preferably symmetrical about a radial vector which extends through the centre 31.

The rims 29", which define the slot lines 29', of the slot-shaped recess 29 can be configured differently so as to adjust the broadband nature of the antenna. These slot lines 29' are preferably configured so as to widen in a funnel shape towards the outside, it being possible for the curve of the rims 29" which define the slot lines 29' to follow an exponential function.

Each slot line 29' is supplied via a slot supply line 35, which proceeds from an intersection or cross point 37 (star intersection 37) positioned in the centre 31 of the substrate 23, which is passed through by the central axis or axis of symmetry 9. From there, each of the slot supply lines 35 initially extends in a radial line portion 35*a*, to which, in the embodiment shown, a second line portion 35*b* extending perpendicular thereto (and extending parallel to the radial vector proceeding from the centre 31) is subsequently attached, so as subsequently to transition into a third line portion 35*c*, again angled off perpendicularly, which intersects the respective slot line 29' transversely and preferably perpendicularly. Other, for example arc-shaped paths of the supply lines 35 are also possible. What is essential is that they proceed from a star point and cross the slot line 29.

So as to improve the broadband nature of these Vivaldi antennae, it is provided that the slot lines 35 in the form of strip lines on the substrate end in a corresponding planar element 35*d*, which can be built in the shape of a triangle, a circle sector or the like.

The respective plurality of angles in the supply slot lines 35 are provided so as each to extend in the same circumferential direction in such a way that each radial line portion 35*a* is followed by a subsequent slot line portion 35*b* etc. continuously in the same circumferential direction.

Figure 6:
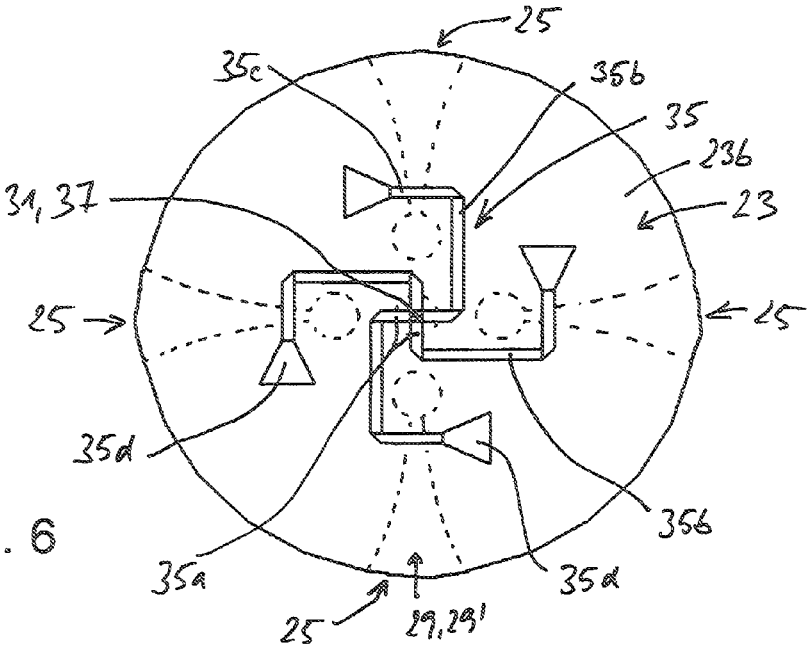
FIG. 6 is a view corresponding to FIG. 5, but showing the rear face of the circuit board or supply structure shown in FIG. 5.

In this context, the aforementioned slot supply lines 35 are formed on the upper side 23*b* of the substrate 23, that is to say opposite the slot lines 29' of the Vivaldi antennae 25 (see FIG. 6, in which the slot lines 29', which are formed on the opposite side of the substrate 25, are drawn in dashed lines).

A coaxial supply line, which leads to the intersection point 37, for this horizontal antenna arrangement is attached in such a way that the external conductor of a coaxial cable 41 is galvanically attached to the conductive layer 27 on the underside 23*b* of the substrate 23, whilst the internal conductor of a coaxial cable connection of this type passes upwards through an opening in the substrate 23 and is galvanically connected to the central star intersection point 37.

As can further be seen from the drawings, the individual slot lines 29', which widen in a funnel shape towards the outside, are arranged in such a way that the outwardly facing opening regions 29*a* thereof each end adjacent to the slots 43 which extend in the casing 11*a* of the cylindrical radiator means 1, 1*a*, in such a way that each Vivaldi antenna, or in general the tapered slot antenna 25, excites the corresponding vertical slot 43.

The circuit board or supply structure is thus distinguished by the fact that, on the circuit board or the substrate 23, the slot lines 29', which result in the slot lines 29' and proceed from the free spaces 33, for all of the slot or Vivaldi antennae 25 form a shared coherent metal-coated surface 27, although the metal-coated surfaces for the individual Vivaldi antennae could be separated, but this is less advantageous. The omnidirectional characteristic can be further improved by increasing the number of the corresponding Vivaldi antennae which are arranged mutually offset in the circumferential direction. In other words, 2 or 3 or 5, 6, 7 etc. Vivaldi antennae could also be arranged so as to be positioned mutually offset in the circumferential direction, in which case a correspondingly larger number of supply lines 35 would have to be provided on the opposite side, the individual supply line portions 35*a*, 35*b*, 35*c* thereof having to be adjusted in terms of angle in such a way that the final supply line portion 35*c*, which provides the actual supply, in each case intersects the associated slot-shaped recess 29, specifically preferably perpendicular to the radial extension thereof.

In summary, it may thus be noted that the supply structure 111 is supplied from below by means of a supply network in the centre, which is provided on the upper side of the circuit board 23, by a coaxial cable 41 (via an internal conductor of the coaxial cable), a Vivaldi antenna 25 (as a special case of a TSA) being supplied via each current-free microstrip line having a broadband stub as an end, said Vivaldi antennae being located on the underside of the circuit board. The electric field propagates from the centre to the edge of the circuit board in each individual Vivaldi antenna, the electric field vector in the slot being parallel to the surface of the circuit board in this context. In other words, the electric field vector is already horizontally polarised with respect to the antenna as a whole. As a result of this electric field, the individual slots 43 are in turn excited so as to radiate.

Conventionally, the omnidirectional antenna is constructed in such a way that the monopole radiator 1 points in the vertical direction, that is to say the counterweight surface is orientated horizontally. Accordingly, the supply structure 111 comprising the circuit board or the substrate 23 is also orientated horizontally (specifically parallel to the counterweight surface and thus perpendicular to the monopole radiator), in such a way that the slot radiators (Vivaldi radiators), which widen preferably in a funnel shape from the inside to the outside, are orientated in the horizontal plane parallel to the counterweight surface 5, and these radiators thus act as horizontal radiators. With a correspondingly different orientation of the antenna, the corresponding vertical and horizontal directions would point in different directions, depending on the antenna orientation.

Thus, in other words, for the relevant slot and/or travelling wave antennae, a supply structure is preferably proposed on a circuit board via which coupling to the slots can be provided from a central point, in particular capacitively. The use of the Vivaldi antennae results in a double radiation-coupled supply at the slots 43, specifically via the supply slot line 35 in relation to the slot line 29' and via this, as regards the supply, to the slots 43, which are provided in the casing 11*a* and extend away from the counterweight surface 5.

As mentioned previously, the supply line 41 for supplying the Vivaldi antenna elements 25 may extend in the interior 11*d* of the rotationally symmetrical and internally hollow body of revolution 11 or radiator casing 11*a*, for example the aforementioned coaxial supply cable 41 being guided through in the interior 11*d* via a hole 45 through the base 11*b* or the casing 11*a* of the vertically polarised antenna means 1 and via a further hole 47 in the counterweight surface 5 on the underside of the counterweight surface 5. On the underside of the counterweight surface 5, the coaxial cable 41 can be attached to a further coaxial plug connection 117. In this context, this portion 41*a* of the supply cable 41 outside the radiator 1 and above the counterweight surface 5 should not be an integer multiple of one half of an operating wavelength which is used by the vertically polarised antenna.

For completeness, it is noted that the vertically polarised monopole radiator 1 is supplied via the aforementioned series (capacitive) supply in the centre of the antenna arrangement (or via the central supply according to FIG. 3 via a plug connector which is provided there) and the horizontally polarised radiator means 3 is supplied via a coaxial supply cable 41 which is positioned offset therefrom, or conversely, said radiator may be supplied in such a way that the Vivaldi antenna means 25 are supplied centrally via a coaxial cable which extends in the central axis 9, whilst the vertically polarised monopole radiator means 1 is supplied via an uncentred coaxial cable which is positioned radially offset therefrom.

Figure 7:
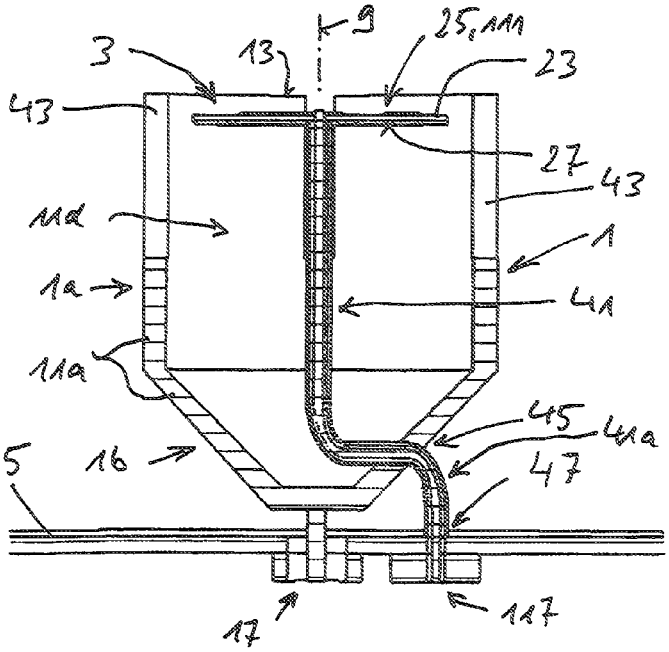
FIG. 7 is a vertical longitudinal sectional drawing, comparable to FIG. 3, but for a modified monopole radiator.

FIG. 7 is a vertical section showing schematically that the monopole vertically polarised antenna means 1 need not necessarily consist of a cylindrical radiation body 1*a*, but may also alternatively consist of a conical or frustum-shaped radiation body 1*b* extending away from the counterweight surface 5, or preferably of a radiation body which, proceeding offset from the earth surface 5, comprises a conically extending first antenna portion 1*b* and a cylindrical antenna portion 1*a* which is attached thereto, as is known in principle from the aforementioned DE 103 59 605 B4, the entire disclosure of which in this regard is incorporated herein by reference. In this way too, a body of revolution 11 or at least approximately a body of revolution 11 is formed as a particularly efficient, vertically polarised monopole radiator. In this case, the slots 43 extending away from the counterweight surface 5 in the radiator casing 11*a* could be formed entirely or in part at the level of the conically extending radiator 1*b* or radiator portion 1*b*, although this will have a slight negative effect on the radiation characteristic.

In the following, modifications will be discussed in greater detail.

Figure 8:
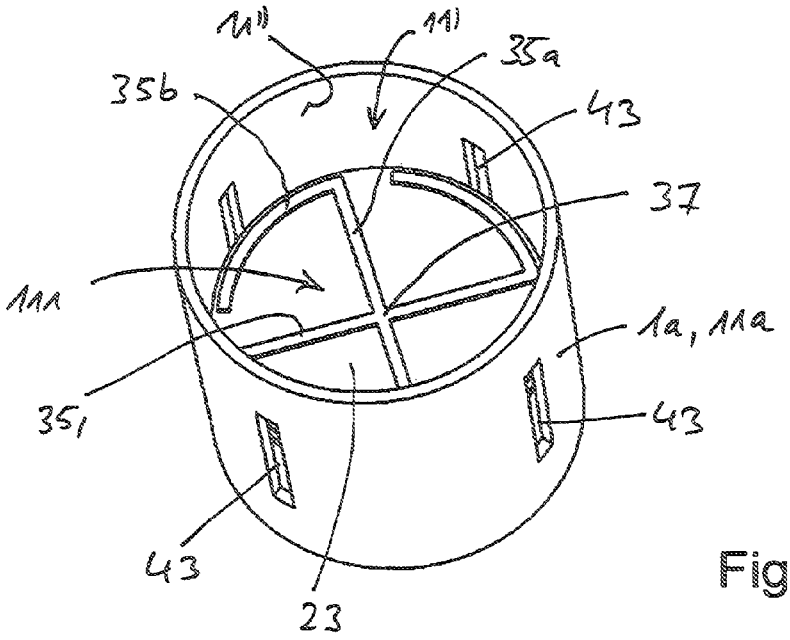
FIG. 8 is a perspective drawing of a modified embodiment of an omnidirectional antenna, not showing the counterweight surface.

FIG. 8 shows a modified embodiment in which the vertical slot 43 in the cylindrical or casing-shaped radiator 1*a* of the vertically polarised monopole radiator 1 is supplied for example via a microstrip radiation coupling, rather than via tapered slot antenna means (TSA).

In this embodiment, a substrate or a dielectric 23 is provided in the interior of the rotationally symmetrical or approximately rotationally symmetrical radiator 1 which is formed as a hollow body, and comprises, proceeding from a central point 37, a slot supply line 35 which also in turn comprises a first radial line portion 35*a* (which proceeds from the aforementioned star point 37) and which subsequently transitions, directly adjacent to the hollow cylindrical or conical casing 11*a* of the radiation means 1, into an arc-shaped slot line portion 35*b* which extends directly adjacent to the internal wall 11" of the radiator casing 11*a* and crosses the vertical slot 43 which is formed therein (preferably parallel to the counterweight surface 5). As a result, the slots 43 can accordingly basically be excited in a conventional manner, as in slot antennae.

Figure 9:
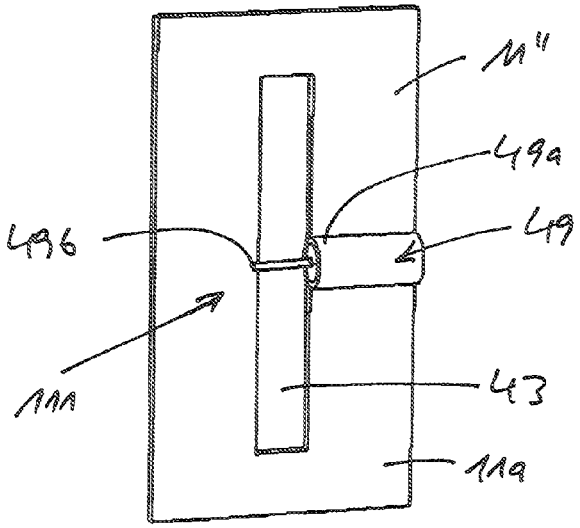
FIG. 9 is a detail of a vertical slot in the casing of the monopole radiator 1 in the case of a coaxial supply structure.

In this case, the additional supply structure 111, which is provided in the interior 11' of the vertically polarised antenna means 1, 1*a*, for the horizontally polarised antenna means can be arranged deeper below the upper circumferential rim 13, in particular partly because it is shown in the embodiment of FIGS. 8 and 9 that in this case the total height H of the cylindrical vertically polarised antenna means 1 can be greater than in the embodiment of FIG. 1, and therefore vertical slots 43 can also be used which are closed in both directions, that is to say defined by a corresponding casing portion of the vertically polarised antenna means 1, rather than being upwardly open on one side. Therefore, unlike in the embodiments of FIGS. 1 to 7, the slot length of the slots 43 should also be $\lambda/2$ rather than $\lambda/4$.

Unlike FIG. 8, the enlarged detail of FIG. 9 shows that the vertical slots 43 (irrespective of whether they are closed or upwardly open as in the embodiments of FIGS. 1 to 4) can be supplied not only via microstrip lines, but also via coaxial cables 49 or any other lines which consist of at least two lines (two-wire line, microstrip, slot line etc.), the external conductor 49*a* of the coaxial cables 49 preferably ending before the respective vertical slots and being galvanically attached to the inner casing 11' of the cylindrical radiator 1, whilst the internal conductor 49*b* crosses the slot 43 and passes it in the transverse direction.

The previous embodiments have exhibited strip-shaped, that is to say in particular rectangular slots 43, 43'. However, the slots may also be of a different shape. For example, it is possible for the slots to be trapezium-shaped or to diverge or converge upwards and downwards in a trapezium shape from a central portion. Various modifications are possible in this context. In general, however, the central longitudinal line of the slots 43, 43' will be made in the radiator casing 11*a* of the body of revolution 11 of the monopole radiator 1, 1*a* in such a way that this central longitudinal line is positioned in the slots 43 in a vertical plane, which is perpendicular to the counterweight surface 5 and in which the central axis or axis of symmetry 9 of the entire omnidirectional antenna is also positioned.

Figure 10:
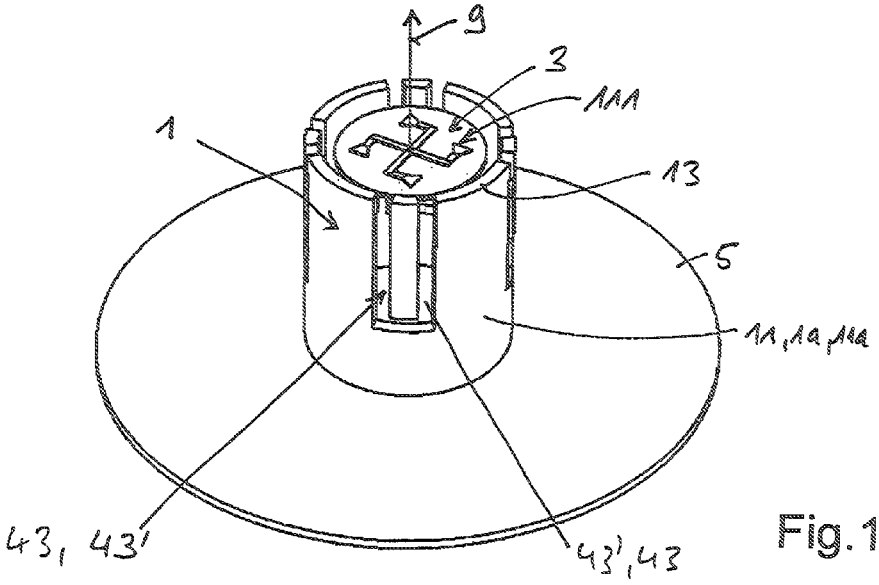
FIG. 10 shows an embodiment modified from FIG. 1 using double slots.

Finally, FIG. 10 is a further detail showing that the slots 43 in the rotationally symmetrical casing 11*a* of the monopole radiator 1 may also be formed as U-shaped double slots 43', which are each upwardly open.

The corresponding wavelengths are each based on the associated operating frequencies in which the omnidirectional antenna is to be used.

In this case, it is provided that the material portions 11*x* which remain between the double slots (and which are metal-coated and/or electrically conductive) are kept in the slots 43 by means of dielectric inserts, or the entire structure is constructed on a dielectric in which accordingly conductive surfaces are formed, specifically by excluding electrically conductive layers in the places where the slots or double slots or U-shaped slots 43, 43' are formed.

An omnidirectional antenna of this type can be used for various operating frequencies or operating bands. In particular, within the available total volume of the antenna, it is possible to have different frequency ranges for the horizontally and the vertically polarised antenna, if this would be advantageous.

The number of slots is selected as a function of the diameter of the monopole. The distance between adjacent slots on the casing of the monopole radiator should not be too large, in particular no larger than $\lambda$ ($\lambda$ being an operating wavelength which is used by the horizontally polarised antenna unit), so as to provide sufficient omnidirectionality of the radiation characteristic of the horizontally polarised antenna.

It is common to all of the described embodiments that the slots 43, 43' are each excited and supplied separately by the supply structure 111, for example in the form of coaxial cables, in the form of a radiation coupling using microstrip lines, or in the form of slot antennae (in particular Vivaldi antennae). This provides linear polarisation in the horizontal plane for a corresponding orientation, specifically when the circuit board structure and the counterweight surface are orientated in the horizontal direction and the monopole radiator points in the vertical direction.

The invention claimed is:

1. A dual-polarized broadband omnidirectional dual-polarized antenna comprising:

a vertically polarized monopole radiator, the vertically polarized monopole radiator being structured to rise above an earth plate or counterweight surface, the monopole radiator comprising a radiator casing which extends away from the earth plate or counterweight surface, the monopole radiator casing having an interior, a horizontally polarized radiator comprising slots, which are provided in the radiator casing of the vertically polarized monopole radiator so as to be positioned mutually offset in the circumferential direction, and a supply arrangement for the horizontally polarized radiator provided in the interior of the vertically polarized monopole radiator, the supply arrangement comprising separate supply, via which the respectively associated slots are excited separately, for a plurality of slots, the supply arrangement comprising a radiation coupling arrangement.

2. Antenna according to claim 1, wherein at least three slots are arranged in the circumferential direction of the monopole radiator so as to be positioned mutually offset at equal distances in the circumferential direction.

3. Antenna according to claim 1, wherein the slots in the radiator casing of the vertically polarized monopole radiator are arranged so as to extend in such a way that they are each parallel to a plane in which an axis of symmetry or central axis, which passes through the antenna and is perpendicular to the counterweight surface, is also positioned.

4. Antenna according to claim 1, wherein the slots are formed so as to extend away from the earth plate or counterweight surface, offset from the earth plate or counterweight surface, in the radiator casing, and end open on the side remote from the earth plate or counterweight surface at the upper rim of the monopole radiator.

5. Antenna according to claim 4, wherein the slots have a length of approximately λ/4.

6. Antenna according to claim 1, wherein the slots are formed so as to extend away from the earth plate or counterweight surface, offset from the earth plate or counterweight surface, in the radiator casing, and are closed on the side remote from the earth plate or counterweight surface, adjacent to the upper rim of the monopole radiator.

7. Antenna according to claim 6, wherein the slots have a length of approximately λ/2.

8. Antenna according to claim 1, wherein the slots in the radiator casing are configured so as to be strip-shaped or so as to extend in a trapezium shape proceeding from the centre thereof towards or away from the earth plate or counterweight surface.

9. Antenna according to claim 1, wherein the supply arrangement comprises coaxial cables, which extend so as to proceed from a center of an intersection point which is formed there and which are connected thereto, the external conductor of each coaxial cable being galvanically attached to one side of a slot and the internal conductor which bridges the slot being galvanically attached to the opposite side of the same slot.

10. Antenna according to claim 1, wherein the radiation coupling arrangement comprises a microstrip supply structure, in which corresponding supply lines are arranged, proceeding from an intersection point, in such a way that the corresponding supply lines go past, in the direct vicinity of an associated slot in the radiator casing of the monopole radiator, so as to cross the slot.

11. Antenna according to claim 1, wherein the vertically polarized radiator is supplied centrally via a recess in the earth plate or counterweight surface.

12. Antenna according to claim 11, wherein the monopole radiator is supplied centrally in a series and/or capacitive manner.

13. Antenna according to claim 12, wherein the earth plate or counterweight surface comprises a recess through which an internal conductor of a coaxial supply line is guided and galvanically connected to an internal conductor coupling element which extends over a particular height above the earth plate or counterweight surface, the internal conductor coupling element being enclosed by a cylindrical coupling portion, which is galvanically connected to the monopole radiator, so as to provide a series and/or capacitive supply to the monopole radiator.

14. Antenna according to claim 1, wherein the horizontally polarized radiator is supplied via a coaxial line, which extends on the side of the earth plate or counterweight surface facing towards the vertically and horizontally polarized radiators, specifically between a through-opening in the earth plate or counterweight surface and a through-opening in the radiator casing, the length of the coaxial cable which extends in this region being selected in such a way that it is not an integer multiple of λ/2 for an operating frequency of the vertically polarized radiator.

15. Antenna according to claim 1, wherein the horizontally polarized radiator is supplied centrally via a recess in the earth plate or counterweight surface.

16. Antenna according to claim 15, wherein the horizontally polarized radiator is supplied in a series or capacitive manner.

17. Antenna according to claim 1, wherein the vertically polarized radiator is supplied via a coaxial line which extends on the side of the earth plate or counterweight surface facing the vertically and horizontally polarized radiator, specifically between a through-opening in the earth plate or counterweight surface and a through-opening in the radiator casing, the length of the coaxial cable which extends in this region being selected in such a way that it is not an integer multiple of λ/2 for an operating frequency of the vertically polarized radiator.

18. Antenna according to claim 1, wherein the monopole radiator comprises an at least approximately conical or frustum-shaped radiator portion, the divergent extension of which points away from the earth plate or counterweight surface, and/or a cylindrical or cup-shaped radiator portion.

19. A dual-polarized broadband omnidirectional antenna comprising:

a monopole radiator, the monopole radiator being vertically polarized, the vertically polarized radiator being structured to rise above an earth plate or counterweight surface, the monopole radiator comprising a radiator casing which extends away from the earth plate or counterweight surface, the omnidirectional antenna being in the form of a dual-polarized antenna, a horizontally polarized radiator, the horizontally polarized radiator comprising slots, which are provided in the radiator casing of the vertically polarized monopole radiator so as to be positioned mutually offset in the circumferential direction, a supply arrangement for the horizontally polarized radiator provided in an interior of the vertically polarized monopole radiator, the supply arrangement comprising a separate supply via which the respectively associated slots are excited separately, for a plurality of slots, wherein the supply arrangement comprises a plurality of slot antennas which are arranged mutually offset in the circumferential direction.

20. Antenna according to claim 19, wherein the supply arrangement consists of or comprises a plurality of Vivaldi or Vivaldi-like antenna structures which are arranged mutually offset in the circumferential direction about a central axis of symmetry of the antenna.

21. Antenna according to claim 20, wherein the Vivaldi or Vivaldi-like antenna structures comprise a substrate, on one side of which a metal-coated or electrically conductive layer is formed, in the region of which slot-shaped recesses, which extend from the inside to the outside, positioned mutually offset in the circumferential direction, are provided so as to form a respective slot line.

22. Antenna according to claim 21, wherein the slot-shaped recesses extend in a funnel shape from the inside to the outside and the antenna further comprises a plurality of supply lines for separately supplying a respective slot line are provided on the substrate on the opposite side.

23. Antenna according to claim 21, wherein slot lines formed proceeding on the substrate from a center so as to be mutually offset in the circumferential direction, extend to the slot lines, and for this purpose each comprise, proceeding from the center, a first radially or approximately radially extending line portion, a second line portion following on at an angle, and a third line portion, again extending at an angle thereto, which bridges the slot line which is formed on the opposite side of the substrate.

24. Antenna according to claim 21, wherein the slot lines proceed, adjacent to the centre of the substrate, from a circular free space.

25. Antenna according to claim 21, wherein the slot lines end in a planar element, which is formed in the shape of a triangle or a circle sector.

26. Antenna according to claim 21, wherein the open region of the slot line of each Vivaldi or Vivaldi-like antenna structure ends adjacent to an associated slot in the radiator casing of the monopole radiator.

27. A dual-polarized broadband omnidirectional antenna comprising:

a monopole radiator, the monopole radiator being vertically polarized, the vertically polarized radiator being structured to rise above an earth plate or counterweight surface, the monopole radiator comprising a radiator casing which extends away from the earth plate or counterweight surface, the omnidirectional antenna being in the form of a dual-polarized antenna, a horizontally polarized radiator, the horizontally polarized radiator comprising slots, which are provided in the radiator casing of the vertically polarized monopole radiator so as to be positioned mutually offset in the circumferential direction, a supply arrangement for the horizontally polarized radiator provided in the interior of the vertically polarized monopole radiator, the supply arrangement comprising a separate supply via which the respectively associated slots are excited separately, for a plurality of slots, and a plurality of Vivaldi or Vivaldi-like antennae arranged in a plane and/or in a plane which is parallel to the counterweight surface.

* * * * *